US008322451B2

(12) United States Patent
Nutley et al.

(10) Patent No.: US 8,322,451 B2
(45) Date of Patent: Dec. 4, 2012

(54) DOWNHOLE APPARATUS AND METHOD

(75) Inventors: Kim Nutley, Aberdeenshire (GB); Brian Nutley, Aberdeen (GB)

(73) Assignee: Swelltec Limited, Dyce, Aberdeen (GB)

( * ) Notice: Subject to any disclaimer, the term of this patent is extended or adjusted under 35 U.S.C. 154(b) by 0 days.

(21) Appl. No.: 13/399,453

(22) Filed: Feb. 17, 2012

(65) Prior Publication Data

US 2012/0145413 A1 Jun. 14, 2012

Related U.S. Application Data

(63) Continuation of application No. 12/536,824, filed on Aug. 6, 2009, now Pat. No. 8,136,605, which is a continuation of application No. PCT/GB2008/000427, filed on Feb. 7, 2008.

(30) Foreign Application Priority Data

Feb. 7, 2007 (GB) ..... 0702356.7

(51) Int. Cl.
*E21B 33/12* (2006.01)

(52) U.S. Cl. ..... 166/387; 166/187

(58) Field of Classification Search ..... 166/387, 166/187, 179, 118

See application file for complete search history.

(56) References Cited

U.S. PATENT DOCUMENTS

| | | | |
|---|---|---|---|
| 2,849,070 | A | 8/1958 | Maly |
| 6,935,432 | B2 | 8/2005 | Nguyen |
| 7,143,832 | B2 | 12/2006 | Freyer |
| 7,431,098 | B2 | 10/2008 | Ohmer et al. |
| 7,703,539 | B2 | 4/2010 | Levy |
| 2004/0194971 | A1 | 10/2004 | Thomson |
| 2005/0199401 | A1 | 9/2005 | Patel et al. |
| 2010/0147508 | A1 | 6/2010 | Foster |
| 2010/0236775 | A1 | 9/2010 | Sevre et al. |

FOREIGN PATENT DOCUMENTS

| | | |
|---|---|---|
| WO | 20051052308 | 6/2005 |

OTHER PUBLICATIONS

International Search Report and Written Opinion regarding corresponding application No. PCT/GB2008/000427, dated Jun. 17, 2008.

*Primary Examiner* — Daniel P Stephenson
(74) *Attorney, Agent, or Firm* — Wong, Cabello, Lutsch, Rutherford & Brucculeri, LLP

(57) ABSTRACT

A downhole apparatus, such as a wellbore packer, is provided with a swellable member and a fluid supply assembly. The fluid supply assembly is to receive fluid and expose the swellable member to the fluid to cause expansion of the swellable member, and comprises a support structure for supporting the swellable member on the body. In a preferred embodiment, the support structure defines a chamber and is configured to allow fluid to flow and access the swellable member. A method of use and method of sealing a wellbore is described.

12 Claims, 6 Drawing Sheets

DOWNHOLE APPARATUS AND METHOD

CROSS-REFERENCE TO RELATED APPLICATIONS

This application is a continuation of U.S. Pat. No. 8,136,605, filed Aug. 6, 2009, which is a continuation of PCT application PCT/GB2008/000427, filed Feb. 7, 2008, which in turn claims priority to United Kingdom Patent Application No. GB0702356.7, filed on Feb. 7, 2007, all of which are incorporated in their entirety by reference for all purposes.

TECHNICAL FIELD

The present invention relates to downhole apparatus, and in particular to an improved swellable downhole apparatus and a method of operation.

BACKGROUND ART

In the oil and gas industry, downhole apparatus including swellable materials which increase in volume on exposure to wellbore fluids are known for use in subterranean wells. For example, swellable wellbore packers are used to seal open-hole or lined wells. Such equipment uses swellable elastomers designed to swell on contact with hydrocarbon fluids or aqueous fluids present in the wellbore annulus.

Successful operation of such apparatus is dependent on the well environment and the composition of the well fluids present to initiate swelling. In some wells, the well fluids are deficient at causing the swellable member to expand due to inherent composition or viscosity. This may result in the apparatus failing to operate properly, for example a swellable packer may not provide the required seal. Many dry wells, such as coal bed methane (CBM) wells, simply have insufficient liquid present to use swellable materials.

Furthermore, variations in composition, flow, and viscosity of wellbore fluid, introduce variations into swelling rates of swellable apparatus. This is undesirable in applications which require a carefully controlled and well-understood swelling process.

A problem associated with prior art apparatus and methods is that the expansion parameters of a swellable apparatus may be difficult to predict, guarantee, or control. In existing apparatus and methods there is a lot of time and expense wasted in trying to control the fluid environment for swellable apparatus in attempts to control the swelling parameters. For example, a suitable swellable fluid may be circulated or spotted around the downhole tool. These techniques for predicting, guaranteeing or controlling swellable tools present their own deficiencies and drawbacks, not least that they add complexity and cost to the wellbore operation.

SUMMARY OF INVENTION

It is an aim of the present invention to obviate or at least mitigate disadvantages and drawbacks associated with prior art apparatus and methods.

Other aims and objects will become apparent from the description below.

According to a first aspect of the present invention, there is provided downhole apparatus comprising: a body; a swellable member which expands upon contact with at least one predetermined fluid; and a fluid supply assembly configured to receive the predetermined fluid and expose the swellable member to the predetermined fluid, wherein the fluid supply assembly comprises a support structure for supporting the swellable member on the body.

Preferably, the support structure is configured to allow fluid flow therethrough. The swellable member may be exposed to the fluid via the support structure.

Preferably, the fluid supply assembly comprises a chamber. The chamber may be at least partially formed in the body. Alternatively, the chamber may be disposed on the body. The body may be tubular. The chamber may be any volume internal to the apparatus which functions to contain fluid or allow fluid to flow, and may be an annular chamber, or may be a fluidly connected network of pores, holes or apertures.

Preferably, the fluid supply assembly is isolated from the wellbore annulus. In certain embodiments, the apparatus may be formed with an axial throughbore for the internal passage of well fluids. In such embodiments, the fluid supply assembly may also be isolated from the fluid in the throughbore. In this way, fluid present in the fluid supply assembly avoids contamination by other well fluids.

Preferably, the apparatus is adapted to prevent or control fluid of the wellbore annulus that can cause expansion of the swellable member. More specifically, the swellable member may comprise a layer and/or coating completely or selectively impervious to fluid of the wellbore annulus.

The apparatus may be adapted to be coupled to well tubing, for example, to facilitate deployment of the apparatus and locating the apparatus downhole for operation.

More specifically, the apparatus may comprise a mandrel adapted to connect to adjacent tubing sections, and which may be formed of API tubing and/or pipe section.

In this embodiment, the swellable member may be located around the mandrel. The fluid supply assembly may then be located between the mandrel and the swellable member. The fluid supply assembly may comprise a chamber which defines a volume between the mandrel and the swellable member, which may be an annular volume. The support structure may define and/or maintain the volume. The mandrel may be provided with a throughbore for fluid flow.

Preferably, the pre-determined fluid may be selected according to required swelling parameters, for example, to control swell time and/or the ratio of the volume of swellable member in expanded state to the volume of fluid provided to the swellable member. The pre-determined fluid may comprise hydrocarbons, water and/or other fluids suitable for effecting expansion of the swellable member. The predetermined fluid may be selected according to viscosity of the fluid or any other parameter that effects or controls the rate of expansion or the total volume expansion of the swellable member. For example, additional fluid properties may include aniline point, paraffinic or aromatic content, pH, or salinity. The apparatus may be adapted to expand on exposure to hydrocarbon and/or aqueous fluids.

Preferably, the apparatus comprises a support structure for the swellable member. The support structure may form part of the fluid supply assembly. The support structure may define a chamber. The support structure may be formed from a metal or other high strength material. The support structure may comprise ports and/or holes for passage of fluid from the volume defined by the chamber to the swellable member. The support structure may comprise a mesh for passage of fluid from the chamber to the swellable member.

The swellable member may abut an outer surface of the support structure. The support structure may allow fluid communication from the fluid supply assembly to the swellable member, thus exposing a surface of the swellable member to a volume of fluid in the chamber to permit expansion.

The support member may function to support the swellable member and to resist inward radial forces imparted by expansion of the swellable member. The support structure may comprise a plurality of discrete support members. This may provide improved structural integrity and additional support for the swellable member. The support structure may function to provide radial support to the swellable member while maintaining a fluid path to allow it to be exposed to an activating fluid. The support structure functions to direct radial expansion of the member outwardly rather than inwardly.

The support structure may comprise a porous body, and/or may comprise a network of pores, apertures or voids through which fluid can pass. Fluid supplied from the fluid supply assembly may therefore pass through a volume or chamber, which may be axial or annular, defined by the support structure. In one embodiment, the support structure is formed from a porous material, which may be of woven fibres, braided wire, metal wool or a sintered metal. In yet another embodiment, the support structure may be formed from a combination of support members and spaces bounded by the body and the swellable member.

Further, each support member may be in fluid communication with adjacent support members. The support members may be interchangeable for facilitating construction of apparatus, and/or for allowing apparatus of different sizes and/or specifications to be constructed using common/standard components.

The volume of the chamber may be selected according to the required swelling parameters of the swellable member.

The fluid supply assembly preferably includes a supply line. The fluid supply assembly may be supplied with fluid from surface via the supply line. Alternatively, or in addition, the fluid supply assembly may be supplied with fluid from a reservoir of fluid coupled to the apparatus. The reservoir may be located downhole, and may be longitudinally displaced from the apparatus. The supply line may be provided with flow control valves to control fluid supply.

According to a second aspect of the invention there is provided a downhole apparatus comprising: a body; a swellable member which expands upon contact with at least one predetermined fluid; and a fluid supply assembly; wherein the fluid supply assembly is configured to receive the predetermined fluid and expose the swellable member to the predetermined fluid, and comprises a fluid supply line and a chamber in fluid communication the swellable member.

The fluid supply assembly and/or chamber may be in fluid communication with the swellable member in normal use, and may be in fluid communication with the swellable member during run-in.

Preferred and optional features of the second aspect of the invention may comprise preferred and optional features of the first aspect of the invention as defined above.

According to a third aspect of the invention, there is provided a wellbore packer comprising the apparatus of the first or second aspects of the invention.

According to a fourth aspect of the invention, there is provided a downhole assembly comprising the apparatus of the first or second aspects of the invention, and a downhole fluid reservoir in fluid communication with the supply line of the apparatus.

According to a fifth aspect of the invention there is provided a method of operating a swellable downhole apparatus, the method comprising the steps of: a.) providing an apparatus, the apparatus comprising a swellable member which expands upon contact with at least one predetermined fluid and a fluid supply assembly comprising a support structure for supporting the swellable member; b.) supplying at least one predetermined fluid to the fluid supply assembly; and c.) expanding the swellable member by exposing the swellable member to fluid from the fluid supply assembly.

The method may include the step of expanding the swellable member by exposing the swellable member to fluid from the wellbore annulus. For example, the fluid supply assembly may be filled with a fluid to enact swelling from the inside of the swellable member while a fluid present in the wellbore annulus will swell the swellable member from the outside in.

Preferably, the method includes the steps of running the downhole apparatus to a downhole location.

The method may comprise the step of supplying fluid to the fluid supply assembly. The fluid may be supplied at surface. Alternatively, or in addition, fluid may be supplied from surface when the apparatus is at the downhole location.

The method may comprise the step of supplying fluid into the support member.

Alternatively, or in addition, the fluid may be supplied from a reservoir of fluid located downhole.

The fluid supply assembly may comprise a chamber, and the method may comprise the step of filling the chamber with fluid via a supply line. The step of filling the chamber may be carried out at surface, and the apparatus may subsequently be run to the downhole location.

The chamber may be filled from surface and/or from a reservoir of fluid located downhole. The reservoir may comprise a predetermined volume of fluid for supply to the chamber.

The apparatus may be the apparatus according to the first aspect of the invention.

According to a sixth aspect of the invention there is provided a method of sealing a wellbore comprising the method steps of the fifth aspect of the invention.

According to a seventh aspect of the invention, there is provided a method of sealing a wellbore of approximately known dimensions, the method comprising the steps of: providing a downhole apparatus having a swellable member which expands upon contact with at least one predetermined fluid from a run-in condition to a sealing condition and a fluid supply assembly; determining a required volume of the predetermined fluid to expand the swellable member from a run-in volume in the run-in condition to a sealing volume in the sealing condition; running the apparatus to the downhole location; and exposing the swellable member to a supplied volume of the predetermined fluid via the fluid supply assembly to create a seal in the wellbore.

With the present invention, it is possible to predict the required volume of fluid $V_f$ which is required to increase the volume from $V_1$ to $V_2$, and the invention allows the swellable member to be exposed to a volume of predetermined fluid greater than $V_f$ in a controlled manner. In one embodiment the capacity of the chamber is greater than the required volume of fluid $V_f$, such that an excess or surplus of fluid is available. An excess or surplus of fluid allows additional swelling of the swellable member, for example if the diameter of the wellbore increases due to a change in or damage to the formation, or if the packer is required to swell in an area of a damaged tubular or washout zone. It also accounts for replacement of fluid that may have leaked out of the chambers.

According to an eighth aspect of the present invention, there is provided downhole apparatus comprising a body; a swellable member disposed on the body which expands upon contact with at least one predetermined fluid; and a fluid supply assembly; wherein the fluid supply assembly is arranged to receive the predetermined fluid and expose the swellable member to the predetermined fluid.

According to a ninth aspect of the present invention, there is provided a method of operating a swellable downhole apparatus, the method comprising the steps of: locating an apparatus downhole, the apparatus comprising a swellable member which expands upon contact with at least one predetermined fluid and a fluid supply assembly; and expanding the swellable member by exposing the swellable member to fluid from the fluid supply assembly.

Preferred and optional features of the eighth and ninth aspects of the invention may comprise preferred and optional features of the first and fifth aspects of the invention as defined above.

DETAILED DESCRIPTION

Figure 1:
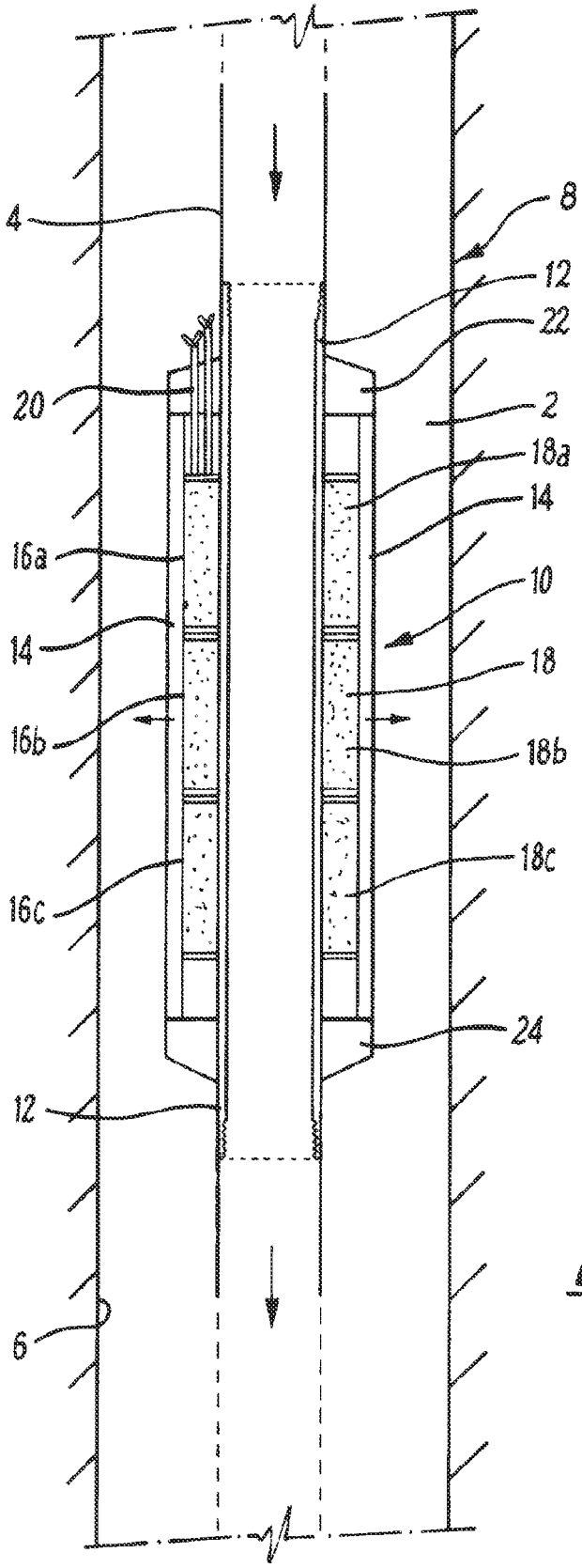
FIG. 1 is a longitudinal section of a swellable packer located in a wellbore according to an embodiment of the present invention.
Figure 2:
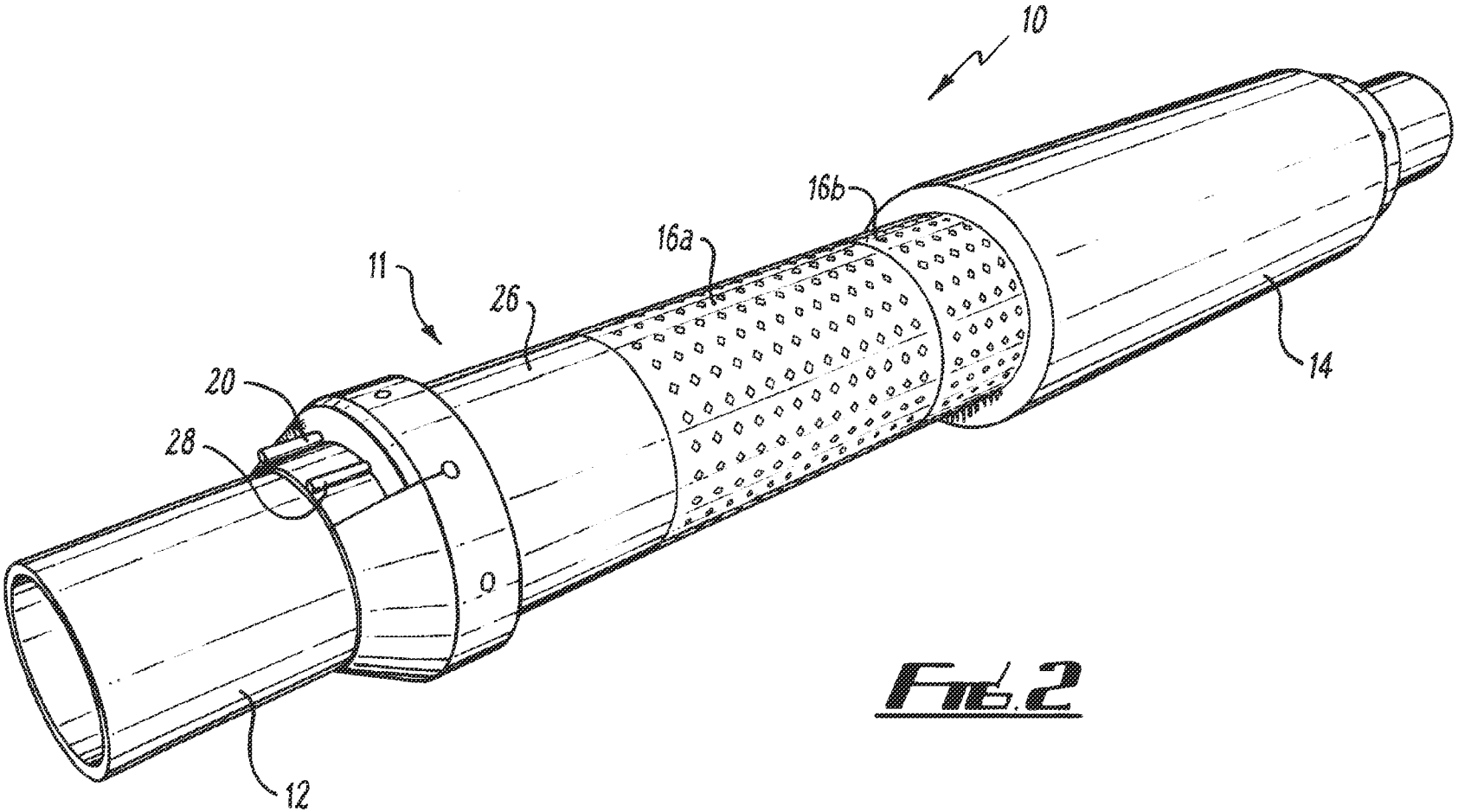
FIG. 2 is a perspective view of the swellable packer of FIG. 1 with a swellable member partially cut away for visibility of internal components.

With reference firstly to FIGS. 1 and 2 there is shown generally a swellable packer 10 according to an embodiment of the present invention. In FIG. 1, the packer is shown located for operation in a wellbore, and FIG. 2 provides a perspective view of internal and external components of the packer.

The swellable packer 10 is suitable for sealing a wellbore annulus 2 between wellbore tubing 4 and a wall 6 of a wellbore 8. The wellbore wall could be the surface of a subterranean well or the inside of another larger tubular, such as a casing. Sealing is achieved by expansion of a swellable member 14 of the packer upon contact with fluid either present in a chamber 18 or the wellbore annulus 2, as will be described below.

In this example, the swellable packer 10 has a generally tubular structure, comprising a body in the form of an inner mandrel 12, which can be coupled to other downhole tubing, and provides for the flow of fluid through the tubing and the mandrel 12. It will be appreciated that in other embodiments, the swellable member may be mounted on a body not having a throughbore, for example a mandrel of a wireline tool.

Around the mandrel 12 there is located a support structure consisting of a number of support members 16*a* to 16*c*. Outwardly of the support structure is located the main swellable member 14, which extends around a circumference defined by outer surfaces of the support members 16 along the length of the packer. The packer is configured such that the swellable member expands into the annulus 2 on contact with a suitable selected activating fluid, in this case a liquid hydrocarbon.

The support members 16*a* to 16*c* form part of a fluid supply assembly, and define an annular chamber 18 made up of fluidly connected annular sub-chambers 18*a-c* between an outer surface of the mandrel 12 and the swellable member 14. The chamber 18 is a volume internal to the apparatus which functions to contain fluid or allow fluid to flow. Fluid for causing the swellable member to expand that is located in the chamber 18 is in fluid communication with the swellable member 14 via apertures (not shown). The chamber 18 is filled with fluid via a fluid fill line 20 connected to sub-chamber 18*a*.

The structure of the packer 10 is described in more detail with reference now to FIGS. 3A to 3D and FIG. 4. In the present embodiment, the packer is constructed around the mandrel 12. The mandrel 12 is formed from API pipe and is provided in this case with threaded sections (not shown) at each end for connection to adjacent tubing sections.

Figure 4A:
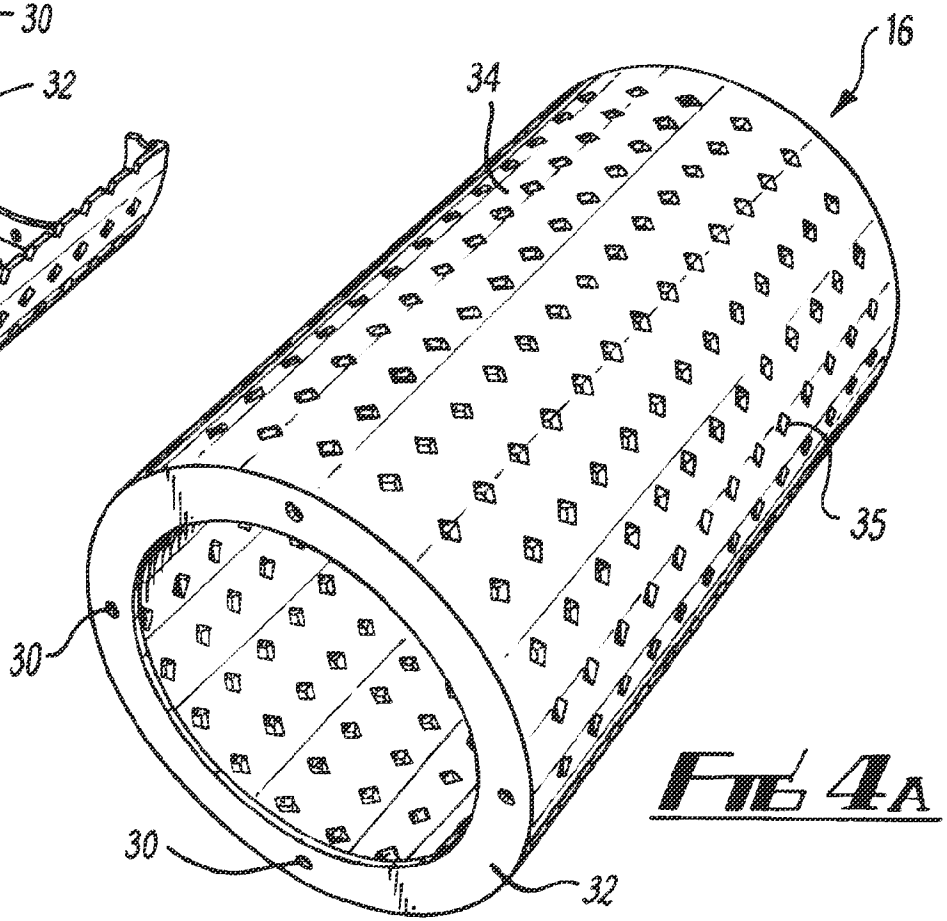
FIGS. 4A and 4B are respectively perspective and perspective cutaway views of a support member for use with the swellable packer of FIGS. 1 and 2.
Figure 4B:
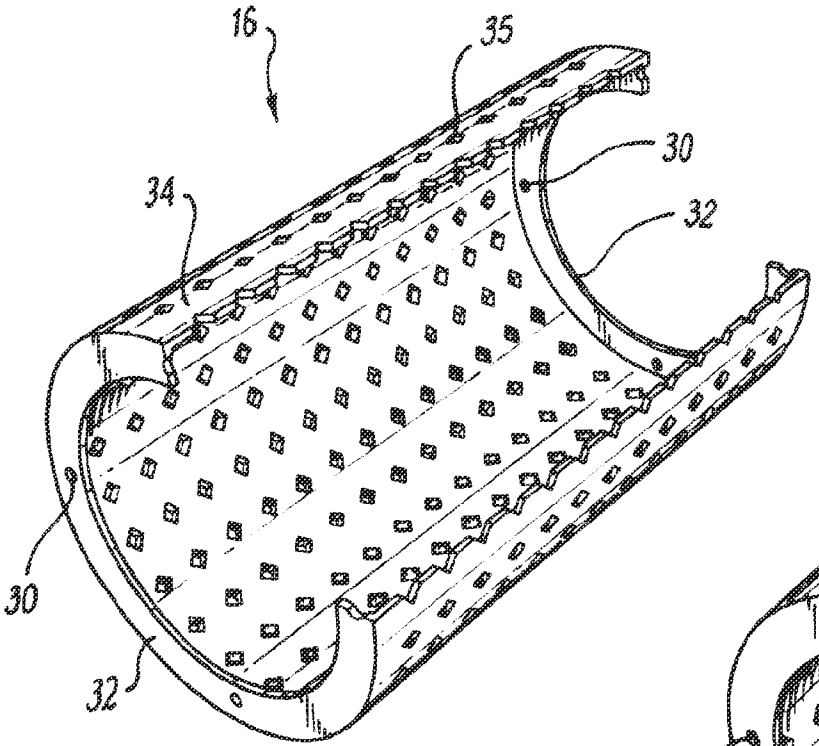

Three discrete support members 16*a* to 16*c* are slidably located around the mandrel 12 so that they abut each other at their respective ends. The support members 16, as can be seen in FIG. 4, each comprise a tubular mesh sleeve 34 with apertures 35 to allow for the passage of fluid. At each end, the support member 16 is provided with inwardly protruding flange 32. The tubular mesh sleeve 34 and flange 32 together define an annular inner volume or hollow. The flanges 32 have an inner diameter similar to the outer diameter of the mandrel 12 so that the elements fit closely around the mandrel 12 and rest against the mandrel on the inner circumference of the flange 32 to provide structural support.

Figures 3A, 3B:
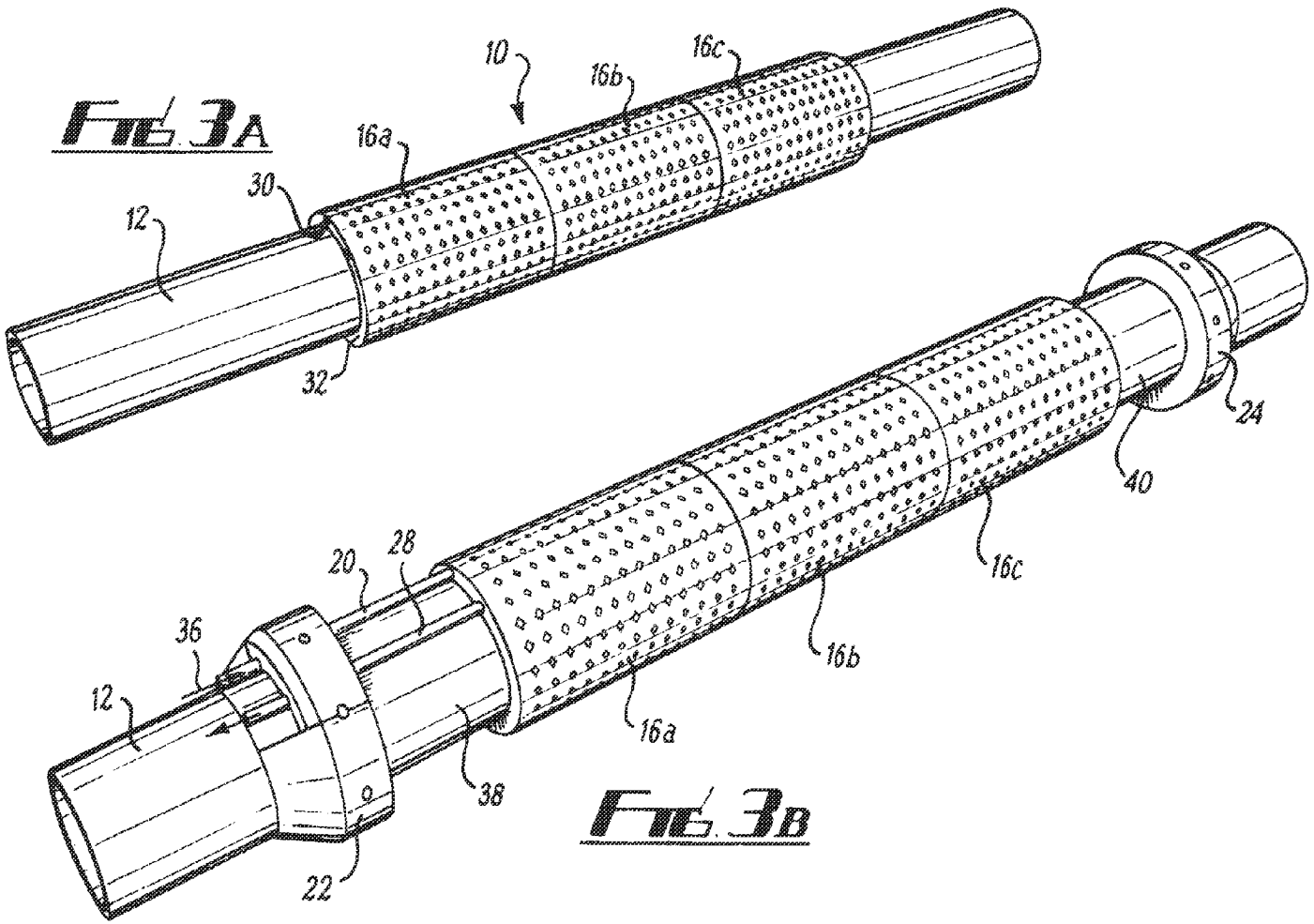
FIGS. 3A to 3D are perspective views of the packer of FIGS. 1 and 2, at different constructional stages.

When located on the mandrel 12 as shown in FIG. 3A, the tubular mesh sleeve 34 is separated from an outer surface of the mandrel such that the support members 16*a-c* each define a annular sub-chamber 18*a-c* between the outer surface of the mandrel and an inner surface of the sleeve 34. The support members 16 are connected so that fluid may pass from a first to a second mesh element via fluid connection ports 30 in the end members 32 to provide a connected chamber 18. Thus, by using and connecting different numbers of mesh elements, different sizes of packers can be constructed using the same components.

In FIG. 3B, the packer is shown at a further stage of construction with the end members 22 and 24 fitted and fixed to the mandrel 12. The end members 22, 24 are stops or collars of increased outer diameter relative to the mandrel 12. The end member 22 is provided with a fluid fill line 20 and a fluid return line 28 connected to the fluid connection ports 30 of the first support member 16. The chambers 18 are filled with fluid according to arrow 36 through fill line 20. The supplied fluid enters the chambers of adjacent support members 16*b-c* through ports 30 (which may be aligned) in adjacent support members providing a large connected chamber 18 volume for exposing fluid to the swellable member 14.

The fluid return line allows fluid to be expelled from the chamber when it is full. During filling, flow of fluid through the return line 28 indicates that the chamber is full. The lines can then be closed.

At an opposing end, the second end member 24 is provided and fixed to the inner mandrel. The end members 22, 24 are positioned along the mandrel 12 such that there are spaces 38, 40 between the end members 22, 24 and the support members 16*a*, 16*c*, into which are located inserts 42*a*, 42*b* of swellable material to build up the diameter to that of the support members. The inserts are bonded to the mandrel 12 and the adjacent support members. The fill and return lines 20, 28, are embedded into the insert 42*a*.

Figures 3C, 3D:
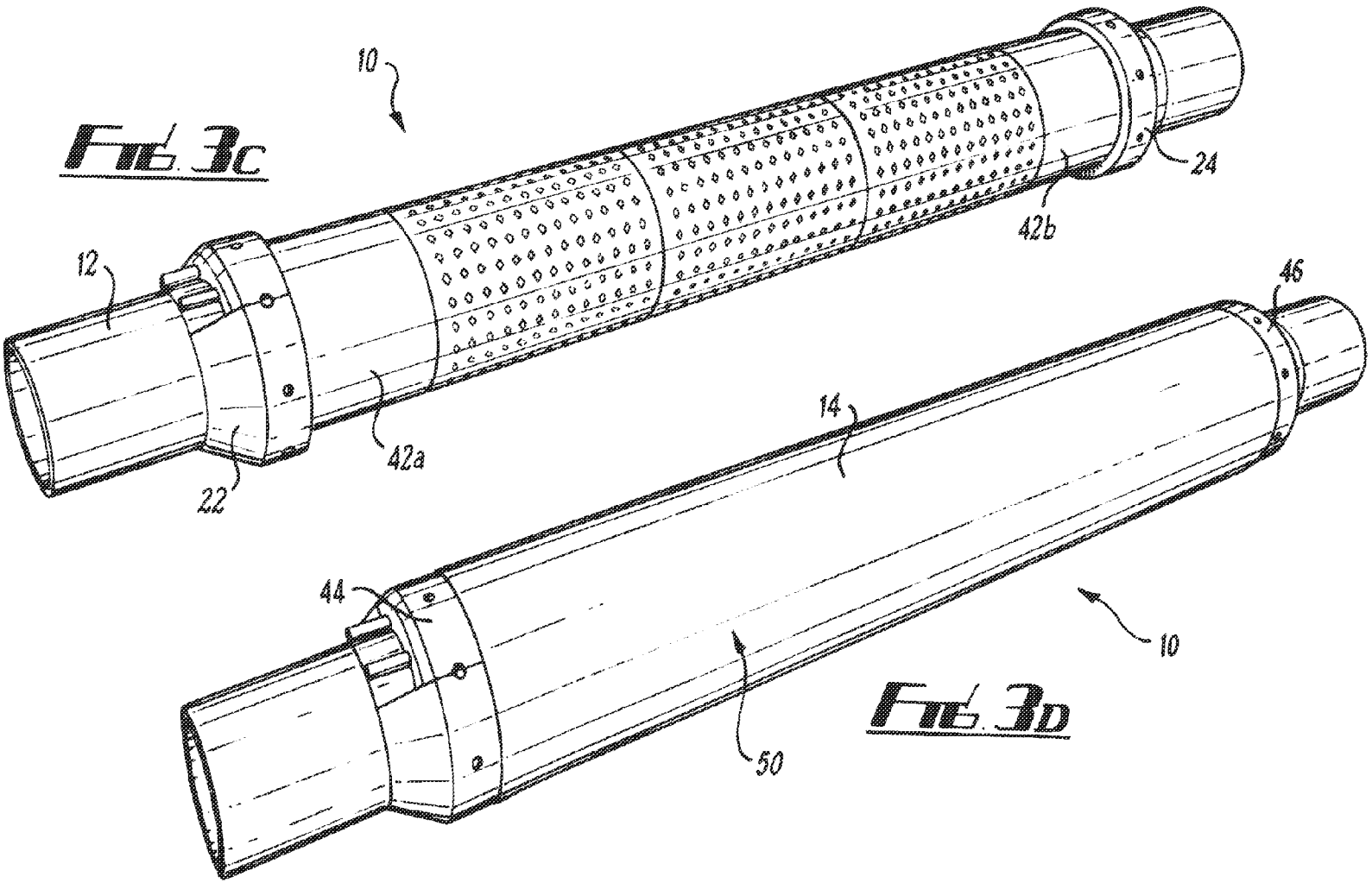

In FIG. 3D, the packer 10 is shown fully constructed, with the swellable element 14 located around the inserts 42 and support members 16A to 16C providing a uniform outer surface along the length of the packer. The swellable element 14 abuts outwardly protruding portions 44, 46 of the end members, which function to keep the mesh elements, inserts 42 and swellable member 14 in place longitudinally and resist its extrusion. In this embodiment, the components are generally tubular components which slipped onto the mandrel, and by nature of their tubular structure are kept in place around the mandrel. The swellable member 14 is bonded to the inserts 42*a*, 42*b* the support members 16. The outer diameter of the swellable element 14 is similar to the outer diameter of the end members 22, 24.

In this embodiment, the swellable element 14 is also provided with a coating 50 provided over its outer surface. The coating prevents ingress of fluid from the well annulus 2 to the swellable member. Thus, expansion of the swellable element 14 caused by wellbore fluid is avoided and so that expansion of the element 14 is controlled solely by fluid supplied internal to the well packer 10 via the fluid supply assembly and chamber 18.

In another embodiment, the swellable element 14 is also provided with a coating or layer 50 provided over its outer surface. The coating or layer allows the ingress of selective fluids from the well annulus 2 to the swellable member. Thus, expansion of the swellable element 14 is caused by both selective wellbore annulus fluid and by fluid supplied internal to the well packer 10 via the fluid supply assembly and chamber 18. For example, the coating or layer 50 may allow the ingress of aqueous fluids but not hydrocarbon based fluids while the chamber 18 is filled with a hydrocarbon based fluid.

In use, the packer 10 described above is connected at surface to well tubing via the mandrel 12. Fluid is supplied to fill the internal sub-chambers 18*a-c* of the packer via fluid supply lines. When the chambers are detected to have been filled, e.g. by the return of fluid via the return lines 28, the fill lines are closed off. The packer is then run into the well to the location where a seal of the well annulus is required. The fluid contained in the chamber passes through holes in the mesh sleeve 34 into contact with the swellable member. The activating fluid diffuses progressively through the elastomer, causing expansion to occur over a predetermined and desirable period, for example in the order of a few days. The rate of expansion is dependent on the diffusion rate of fluid into the swellable material, which can be dependent on parameters such as viscosity of the fluid, fluid composition, aniline point, ratio of paraffinic to aromatic content, pH or salinity.

The fluid is selected using one or more of the above parameters to ensure expansion of the swellable member at a predictable expansion rate.

The capacity of the chamber is selected to provide an excess of fluid required for normal operation of the packer. The packer 10 is configured to provide a seal in a particular size, or range of sizes, of bore. To provide such a seal in normal conditions, the swellable member 14, which has a volume $V_1$ before swelling, is required to expand to a volume $V_2$, and increases in volume by a known factor. With the present invention, it is possible to predict the required volume of fluid $V_f$ which is required to increase the volume from $V_1$ to $V_2$, and the invention allows the swellable member to be exposed to a volume of predetermined fluid greater than $V_f$ in a controlled manner. In this embodiment the capacity of the chamber is greater than the required volume of fluid $V_f$, such that an excess or surplus of fluid is available. This excess or surplus of fluid allows additional swelling of the swellable member, for example if the diameter of the wellbore increases due to a change in or damage to the formation, or if the packer is required to swell in an area of a damaged tubular or washout zone. It also accounts for replacement of fluid that may have leaked out of the chambers.

As expansion takes place, the swellable member exerts a force against the support members. The support members are formed from a strong metal material to withstand this force. Further, the use of several discrete support members supports the swellable member over the length of the packer and prevents damage or deformation to the mesh components or the packer by forces imparted during expansion or during the installation of the tool into a subterranean well. The support structure thus maintains the fluid supply to the swellable member.

In an alternative embodiment (not depicted), a fluid chamber is formed in the mandrel wall itself, with access holes for passage of fluid to contact the swellable member. The support structure is thus unitary with the body. In a further alternative, a chamber is formed in reduced diameter sections of the mandrel. In these alternative embodiments, the outer diameter of the constructed tool may be reduced relative to the embodiment of FIGS. 1 to 4. Such embodiments may have particular application in narrow wellbore or close tolerance systems.

In a further specific embodiment, the activating fluid is stored in a reservoir at a different location on the tubing string, for example, built in or around a wall of the tubing string or another downhole tool. The activating fluid may then be supplied from the reservoir to the chambers when required via supply lines. Typically the fluid reservoir would be under hydraulic pressure or be forced out through, for example a spring force that may arise from a helically coiled metallic spring, or through expansion of a pressurized gas. The volume of fluid contained in the reservoir may be selected to be greater than the volume of the chambers, to provide a surplus of fluid. This excess fluid allows additional swelling of the swellable member, for example if the inner diameter of the wellbore increases due to a change in or damage to the formation. It also accounts for replacement of fluid that may have leaked out of the chambers.

In other embodiments, supply of fluid to the apparatus is from the surface whereby dedicated fill and/or return lines are connected to the downhole tool and run from the setting depth all the way back to surface. In one specific embodiment, this allows for the constant circulation of an activating fluid from surface.

Figure 5:
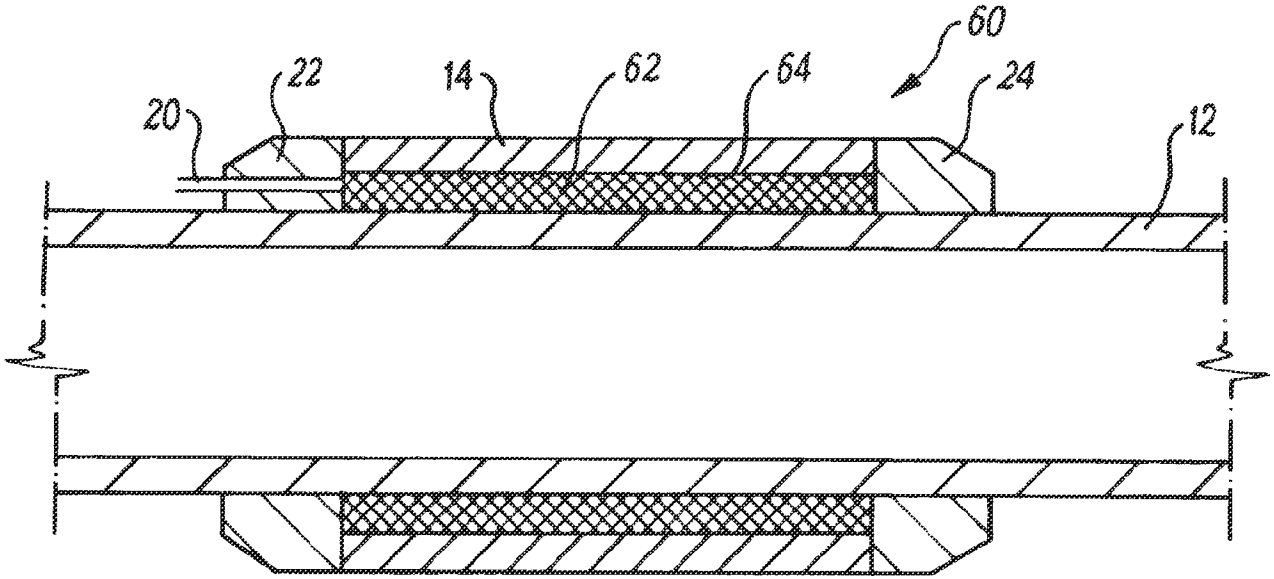
FIG. 5 is a longitudinal section of a swellable packer in accordance with a further alternative embodiment of the invention.

Referring now to FIG. 5, there is shown a further alternative embodiment of the invention in the form of a packer, generally depicted at 60. The packer 60 is similar to the packer 10 of FIGS. 1 to 5, and comprises a support structure 62, disposed between a swellable member 14 and a tubular body 12. A pair of end members 22, 24 longitudinally retains the swellable member 14 and support structure 62 on the body, with the end member 22 comprising a fluid supply line 20. The support structure 62 defines a chamber 64, which differs from the chamber 18. In this embodiment, the support structure 62 is a three-dimensional mesh or matrix of metal formed into a tubular structure. The support structure 64 comprises a network of pores and apertures through which fluid can pass. Fluid supplied from line 20 may therefore flow in an axial chamber defined by the support structure. In another embodiment, the support structure is formed from a porous material such as a tubular of woven fibres or a sintered metal tube. In yet another embodiment, the support structure is formed from a combination of support members and spaces bounded by the body 12 and the swellable member 14.

The swellable member 14 abuts the support structure 62 on its outer surface, and functions to provide radial support to the swellable member while maintaining a fluid path to allow it to be exposed to an activating fluid. The support structure functions to direct radial expansion of the member outwardly rather than inwardly.

Figure 6:
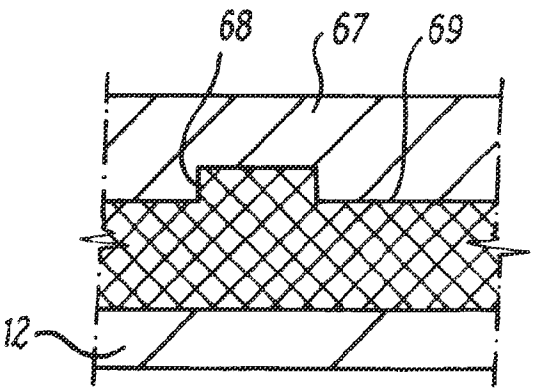
FIG. 6 is a detailed sectional view of a further alternative embodiment of the invention.

FIG. 6 shows a detail of an alternative embodiment of the invention, similar to that of FIG. 5, and comprising a support structure 66 disposed between a swellable member 67 and a body 12. In this embodiment, the support structure 66 is formed form a porous sintered metal and is provided with raised annular formations 68 upstanding from its outer surface 69. The formations 68 are provided to increase the contact area between the support structure and the swellable member 67, and thus the access of fluid in the fluid chamber to the swellable member and the rate of swelling. The formations also reduce the likelihood of slippage between the support structure and the swellable member. In alternative embodiments, formations may be provided in other shapes, for example ridges and grooves.

The apparatus and method described here provides significant benefits. In particular, by providing a separate fluid supply mechanism, which may be internal to the apparatus, swelling can be initiated regardless of conditions in the well.

Also, the activating fluid is not contaminated by other well fluids such that the composition and/or viscosity of the fluid actually causing the swelling is known during installation and can be selected to produce a predictable swelling behavior. Specifically, the fluid may be selected to control the ratio of the volume of fluid provided to the swellable member and the volume of the swellable member when expanded.

In addition, the volume of activating fluid to which the swellable member is exposed can be pre-determined and supplied to control swelling. This is achieved in the present packer apparatus by selecting chamber size, selecting how much fluid to supply to the chamber, the nature of the passageway for fluid communication between the chamber the swellable member, and/or providing activating fluid in isolation from other well fluids.

Various modifications and changes may be made within the scope of the invention herein described.

What is claimed is:

1. A downhole apparatus comprising:

a body;

a swellable member disposed on the body which expands upon contact with a predetermined fluid; and a fluid supply assembly configured to receive the predetermined fluid and expose the swellable member to the predetermined fluid, comprising:

a support structure for the swellable member, formed from a porous material, wherein the fluid supply assembly is supplied with fluid from a reservoir of fluid coupled to the apparatus, wherein the reservoir is located downhole and longitudinally displaced from the apparatus.

2. The downhole apparatus of claim 1 wherein the porous material comprises woven fibres.

3. The downhole apparatus of claim 1, wherein the porous material comprises braided wire, metal wool or a sintered metal.

4. The downhole apparatus of claim 1, wherein the support structure is formed from a combination of support members and spaces bounded by the body and the swellable member.

5. A wellbore packer comprising the downhole apparatus claim 1.

6. A downhole assembly comprising:

the apparatus of claim 1; and a downhole fluid reservoir in fluid communication with a supply line of the apparatus.

7. A method of operating a swellable downhole apparatus, the method comprising:

providing an apparatus according to claim 1;

supplying a predetermined fluid to the fluid supply assembly; and expanding the swellable member by exposing the swellable member to the predetermined fluid from the fluid supply assembly via the porous material.

8. The method of claim 7, further comprising: running the apparatus to a downhole location after supplying the predetermined fluid to the fluid supply assembly.

9. The method of claim 7, further comprising: running the downhole apparatus to a downhole location before supplying the predetermined fluid from surface.

10. The method of claim 7, wherein supplying a predetermined fluid to the fluid supply assembly comprises:

supplying the predetermined fluid from a reservoir of fluid located downhole.

11. The method of claim 7, wherein expanding the swellable member by exposing the swellable member to the predetermined fluid from the fluid supply assembly via the porous material comprises:

exposing the swellable member to a supplied volume of the predetermined fluid to expand the swellable member from a first run-in condition to a sealing condition to create a seal in a wellbore of approximately known dimensions.

12. The method of claim 11, wherein the supplied volume comprises an excess of fluid over a required volume for expanding the swellable member from the run-in condition to the sealing condition.

* * * * *